US005121727A

United States Patent [19]

Kramer et al.

[11] Patent Number: 5,121,727

[45] Date of Patent: Jun. 16, 1992

[54] ADJUSTER FOR A THROTTLE VALVE

[75] Inventors: Claus Kramer, Besigheim; Bernd Taubitz, Schwieberdingen; Karl-Heinz Haegele, Vaihingen/Enz, all of Fed. Rep. of Germany

[73] Assignee: Robert Bosch GmbH, Stuttgart, Fed. Rep. of Germany

[21] Appl. No.: 729,235

[22] Filed: Jul. 12, 1991

[30] Foreign Application Priority Data

Sep. 10, 1990 [DE] Fed. Rep. of Germany ..... 4028702

[51] Int. Cl.[5] ..... F02D 7/00

[52] U.S. Cl. ..... 123/399; 123/337

[58] Field of Search ..... 123/399, 337, 361, 340, 123/479, 400, 403, 561; 180/178, 179, 197

[56] References Cited

U.S. PATENT DOCUMENTS

| | | | |
|---|---|---|---|
| 5,002,032 | 3/1991 | Kolborg | 123/399 |
| 5,014,666 | 5/1991 | Westenberger | 123/339 |
| 5,056,484 | 10/1991 | Danz et al. | 123/399 |
| 5,074,266 | 12/1991 | Kuhn et al. | 123/361 |
| 5,074,267 | 12/1991 | Ironside et al. | 123/399 |
| 5,076,231 | 12/1991 | Büchl | 123/361 |

FOREIGN PATENT DOCUMENTS 3809909 10/1989 Fed. Rep. of Germany .

*Primary Examiner*—Raymond A. Nelli

*Attorney, Agent, or Firm*—Edwin E. Greigg; Ronald E. Greigg

[57] ABSTRACT

An adjuster for an adjusting device which pivots about a pivot shaft, particularly for a throttle valve of an internal combustion engine. The adjuster has an electric control motor for pivoting the adjusting device and a safety restoring unit for moving the adjusting device to a defined basic position upon an interruption to the supply of power to the control motor. To produce the power consumed by the control motor and associated with this to reduce its structural size and weight, the restoring unit is embodied such that its restoring force acting upon the adjusting device is effective solely upon an interruption to the supply of power to the control motor.

14 Claims, 4 Drawing Sheets

ADJUSTER FOR A THROTTLE VALVE

BACKGROUND OF THE INVENTION

The invention is based on an adjuster for an adjusting device that pivots about a pivot shaft, particularly for a throttle valve of an internal combustion engine.

In a known adjuster (German Offenlegungsschrift 32 00 096) for a throttle device that variably widely opens the through cross section of a bypass line around a throttle valve disposed in the intake tube of an internal combustion engine, the restoring unit for the throttle device has a spiral spring, which at one end engages the shaft, rotatably supported in a housing, on which the throttle device is seated in a manner fixed against relative rotation, and on the other end engages the housing. If the supply of power to the control motor is interrupted, in other words in the event of a malfunction or when the engine is shut off, the spiral spring rotates the throttle device to a predetermined position, to uncover a certain through cross section. This has the advantage that on the one hand when the engine is started a predetermined favorable air quantity can flow past the throttle valve via the bypass line, and on the other hand when the supply of power to the control motor is interrupted by some technical defect, a fuel-air mixture that is favorable for further engine operation can be furnished. The restoring force of the spiral spring is effective during the operation of the control motor and must be compensated for by the control motor.

OBJECT AND SUMMARY OF THE INVENTION

The adjuster according to the invention has an advantage that during the control operation of the control motor, no restoring force engages the adjusting device, so that a smaller control motor can be designed with a view to lower power consumption. This also reduces its structural size and weight. Greater dynamics for the adjuster and a longer service life are associated with these provisions. The restoring force of the safety restoring unit is activated only in a malfunction, or in other words when the supply of power to the control motor is interrupted.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
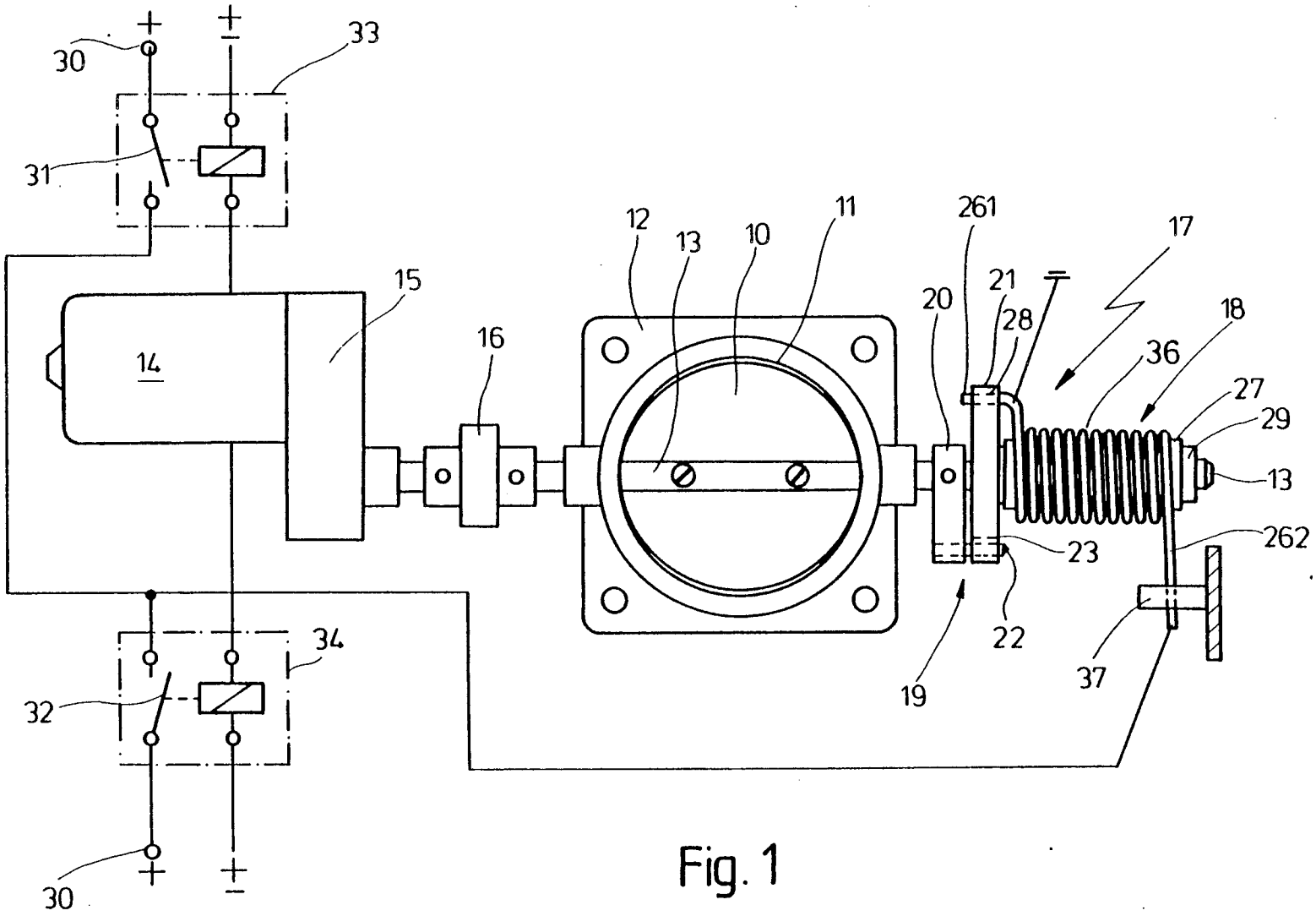
FIGS. 1 and 2 each show a side view of an adjuster for a throttle valve of an internal combustion engine, in two exemplary embodiments.
Figure 3:
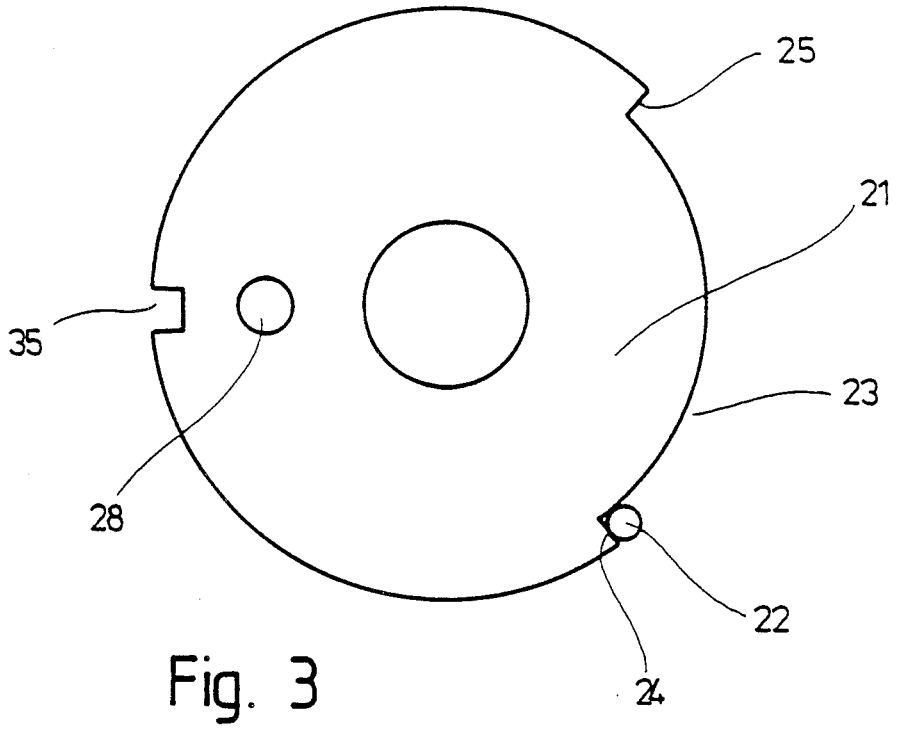
FIGS. 3 and 4 each show an enlarged plan view of one of the coupling elements in the adjuster of FIG. 1 or 2 in two different rotational positions, specifically in the event of a malfunction (FIG. 3) and in control operation (FIG. 4)

With the adjuster shown in a side view in FIG. 1, a throttle valve 10 of an internal combustion engine is rotated over a swiveling range of approximately 90°; this valve opens the through cross section of a flow line 11 in the intake tube 12 of the engine to a variable extent. To this end, the throttle valve 10 is mounted in a manner fixed against relative rotation on a control shaft 13, which is rotatably supported in the intake tube 12. The adjuster has an electric control motor 14, which via a gear 15 with a tolerance-compensating coupling 16 engages the control shaft 13 of the throttle valve 10. A restoring unit 17 is mounted on the other end of the control shaft 13 and for safety restores the throttle valve 10 to its closed position, if a malfunction interrupts the supply of power to the control motor 14 The safety restoring unit 1 is designed such that its restoring force that engages the control shaft 13 in the "throttle valve closed" direction is activated only if a malfunction occurs, while during normal operation of the control motor 14, the restoring force engaging the control shaft 13 assumes the value of zero. The restoring unit 17 has a tensed restoring spring 18 and a coupling device 19 that can be activated if the power supply to the control motor 14 is interrupted; the coupling device 19 joins the restoring spring 18 and throttle valve 10 to one another. The coupling device 19 includes a first coupling element 20, which is mounted on the control shaft 13 in a manner fixed against relative rotation and is embodied as a radially projecting rotation arm, and a second coupling element 21, which is mounted on the control shaft 13 rotatably with an integral bearing sheath 29 and is embodied as a coupler disk, as can be seen in plan view in FIG. 3. The first coupling element 20 has a coupler tang 22, protruding at a right angle with radial spacing from the control shaft 13 and meshing with a coupler groove 23 of circular arc form on the circumference of the second coupling element 21. The coupler groove 23, which extends over the entire width of the disk and the radial depth of which is greater than the diameter of the coupler tang 22, extends over the maximum pivoting travel of the coupler tang 22; in other words, at maximum adjustment travel of the throttle valve 10 of 90°, it extends over 90° circumferentially, and is defined on each end by a respective stop face 24 and 25 (FIG. 3). The restoring spring 18 is embodied as a shape memory effect element or SME element, specifically being embodied as a spiral, leg or angle spring 26 of nickel-titanium metal. SME elements of this kind are known, and so their function need not be described in further detail here. The SME element used here is an element with a bidirectional effect; that is, above and below its shape-changing temperature of 70°, for example, it assumes its respective shape state, so that there is a reversible process between two predetermined shape states of the angle spring 26. Above and below the shape-changing temperature, the axially bent end 261 shown in FIG. 1 of the angle spring 26 assumes a different pivoted position in each case, the pivoted positions being located more than 90° away from one another rotationally. The angle spring 26 is mounted on an insulating sheath 27, which in turn is seated rotatably on the bearing sheath 29 of the second coupling element 21, and with its bent spring end 261 it extends through an axial bore 28 in the second coupling element 21, while its other end 262 rests on a spatially fixed stop 37. The axial bore 28 and the second coupling element 21 is disposed in such a way, in combination with the angle spring 26, that above the shape-changing temperature, as a result of the angle spring 26, the stop face 24 of the coupler groove 23 rests on the coupler tang 22, when the throttle valve 10 is in the closing position. This rotational position of the second coupling element 21 is shown in FIG. 3 in combination with the coupler tang 22. Below the shape-changing temperature, the angle spring 26 resumes its original shape state, in which the spring end 261 is pivoted by approximately 90°, causing the second coupling element 21 to resume its basic position shown in FIG. 4. Because the throttle valve 10 is still closed, the coupler tang 22 now rests approximately on the stop face 25, and if the rotational position of the second coupling element 21 is unchanged it can be pivoted along the coupler groove 23 unhindered, over the adjustment travel of approximately 90° of the throttle valve 10.

The nickel-titanium alloy of the angle spring 26 has the necessary high electrical conductor resistance for heating the angle spring 26 directly to a temperature above the temperature point for the shape change, when current is flowing through it. To this end, the angle spring 26 is connected via both ends 262, 261 to a source 30 of heating current. The connection is effected via two parallel-connected switch contacts 31, 32 of two switch relays 33, 34. The exciter windings of both switch relays 33, 34 are disposed in the electric circuit of the control motor 14; specifically, the exciter winding of the switch relay 33 is incorporated in the feed line from the direct voltage power supply to the control motor 14, and the exciter winding of the switch relay 34 is incorporated in the return line from the control motor 14 to the direct voltage power supply, or vice versa. Both switch relays 33, 34 are embodied such that when there is current to the exciter winding, the switch contacts 31, 32 are opened, while they are closed if there is a power failure. If the power supply to the control motor 14 is interrupted, at least one switch relay 33, 34 therefore drops and closes the corresponding switch contact 31, 32, resulting in a flow of current through the angle spring 26.

The mode of operation of the adjuster is as follows:

During control operation, the control motor 14 is supplied with power. The switch relays 33, 34 are excited and the switch contacts 31, 32 are opened. The second coupling element 21 acted upon by the SME element angle spring 26 assumes its basic position, shown in FIG. 4, in which with the throttle valve 10 closed, the coupler tang 22 of the first coupling element 20 rests on the stop face 25 of the coupler groove 23, or at least in its vicinity. Based on the engine operating parameters, th control motor 14 turns and adjusts the throttle valve 10 a desired rotational position between a pivot angle of 0° and 90°. With the rotation of the throttle valve 10, the first coupling element 20 pivots as well, so that its coupler tang 22 can move unhindered within the coupler groove 23 in the second coupling element 21. The basic position of the second coupling element 21 is maintained unchanged.

In the event of a malfunction, if the power supply to the control motor 14 is interrupted, at least one switch relay 33, 34 drops, and the corresponding switch contact 31 or 32 closes. The SME element angle spring 26 thus has a heating current flowing through it and it heats beyond its temperature point for the shape change. Once the temperature point for the shape change is exceeded, the angle spring 26 assumes its other rotational position, in which the end 261 of the angle spring 26 has pivoted by approximately 90°. During the shape-changing process, the angle spring 26 performs work and pivots the second coupling element 21 by approximately 90° to the rotational position shown in FIG. 3. In this pivoting process, the stop face 24 of the coupler groove 23 strikes the coupler tang 22 and carries it along with it to the final rotational position. Via the coupler tang 22, the first coupling element 2 and thus the control shaft 13 are rotated until the throttle valve 10 comes to a stop in its closed position. Once the source of heating current is shut off, for instance via the vehicle ignition key, the angle spring 26 cools down again and changes to its basic position, in the course of which the end 261 of the angle spring 26 pivots back in the opposite direction by approximately 90°. The second coupling element 21 is as a result pivoted back to its basic position shown in FIG. 4, and the coupler tang 22 can again move freely in the coupler groove 23 via the pivoting travel of the throttle valve 10.

Figure 4:
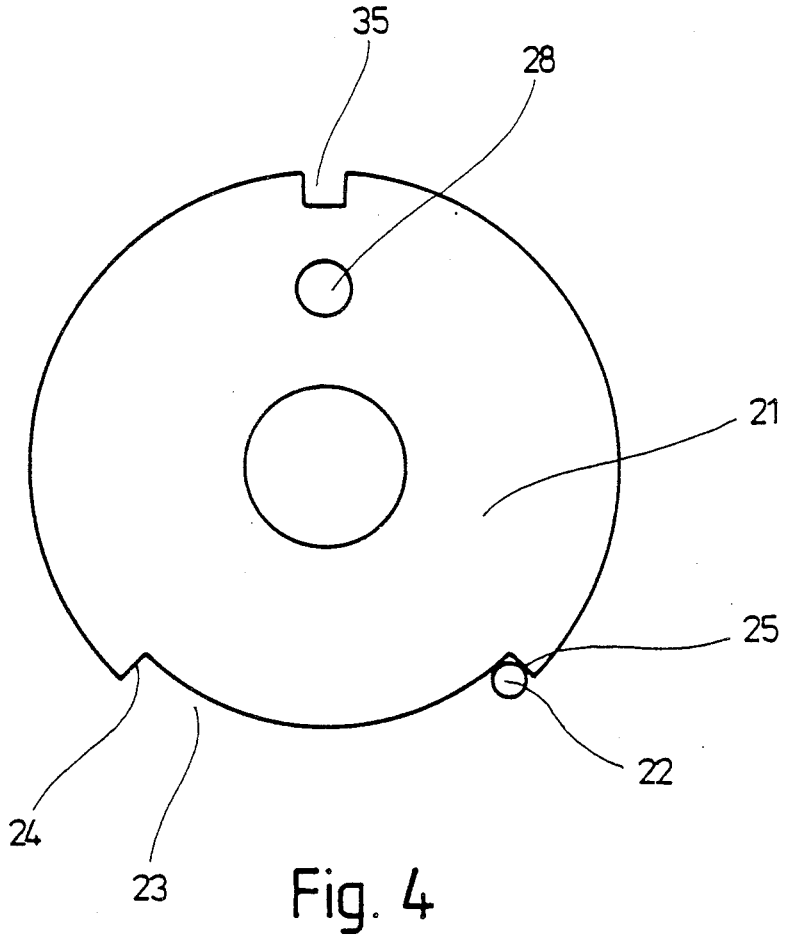

The angle spring 26 may also be embodied as an SME element with a unidirectional effect. In that case, however, the angle spring 26 must be returned to its basic position, which corresponds to the rotational position of the second coupling element 21 as shown in FIG. 4, by some external force. Such a force may be brought to bear on the angle spring 26 via the control motor 14 and the coupling elements 20, 21, by briefly having the control motor 14 shift the throttle valve 10 to the fully open position, that is, its 90° rotational position, while the angle spring 26 is without current and is cooled down. In this rotation of the throttle valve 10, the coupler tang 22, via the stop face 24 of the coupler groove 23, carries the second coupling element 21 along with it, and in turn this element shifts the end 261 of the angle spring 26 to the basic position. Once the second coupling element 21 has assumed the basic position shown in FIG. 4, the throttle valve 10 can be closed again by reversing the control motor 14. The SME element angle spring 26 with the unidirectional effect maintains this position until such time—and for this period of time the second coupling element 21 remains in its basic position—as the temperature point for the shape change is exceeded once again as a result of heating up of the SME element angle spring 26.

Figure 2:
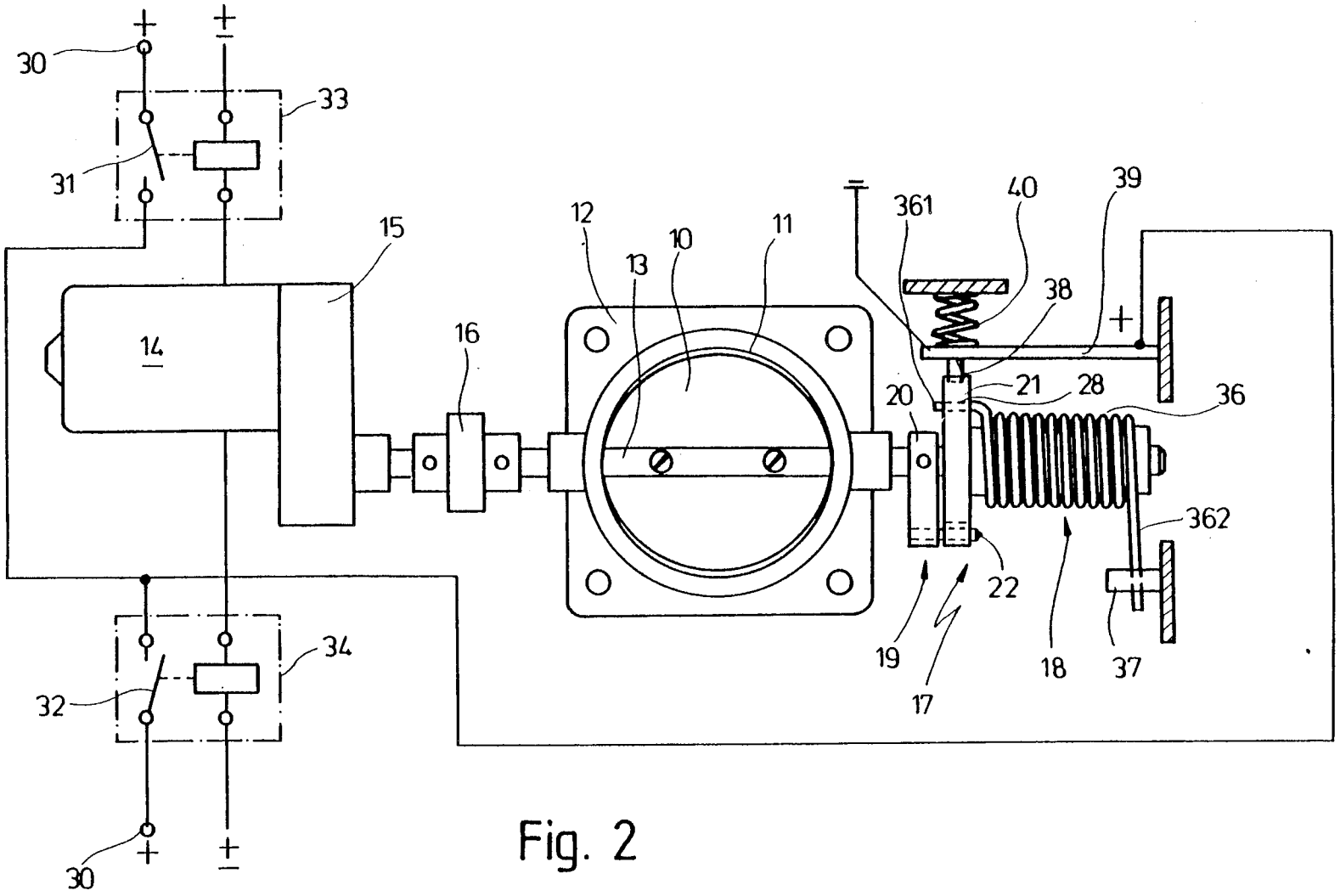

The adjuster sketched in FIG. 2 for a throttle valve 10 is modified compared with the adjuster described above only in the region of the restoring unit 17 and otherwise matches the adjuster described, so that identical components are provided with the same reference numerals. As in the adjuster of FIG. 1, the restoring unit 17 again has the restoring spring 18 and the coupling device 19 with the two coupling elements 20 and 21, which are embodied identically, with the sole difference that the second coupling element 21 also has a groove-like recess 35 on its circumference. The restoring spring 18 is embodied here as a mechanical angle or leg spring 36, which is seated on the bearing sheath 29 of the second coupling element 21 and in the same way as the SME element angle spring 26 of FIG. 1 protrudes through the bore 28 in the second coupling element 21 with its leg 361 bent in the axial direction, and with its other leg 36 it rests on the stop 37 connected to the housing. The leg spring 36 is prestressed and is held in its stressed position by a detent pin 38, which engages the recess 35. The detent pin 38 is seated on the free end of a flexible arm 39 fastened on one end attached to the housing and is held in engagement with the recess 35 by a compression spring 40 engaging the arm 39. In the exemplary embodiment of FIG. 2, the arm 39 is embodied as an SME flexing element with a unidirectional effect, which is aligned rectilinearly, as shown in FIG. 2, below its temperature point for the shape change, while above its temperature point for the shape change it bends, whereupon the detent pin 38 then pivots outward from the recess 35 counter to the force of the compression spring 40. The return of the SME flexible arm 39 to its other shape state after it cools down is effected by the force of the compression spring 40. So that the SME flexing element, i.e., the arm 39, will be heated, it is again connected to the source 30 of heating current via the parallel switch contacts 31, 32 of the two switch relays 33, 34.

The mode of operation of the adjuster of FIG. 2 is largely identical to that of FIG. 1, and so reference is made to the description of that embodiment to this extent. In the event of a malfunction, at least one relay 33 or 34 drops, and the SME flexing element, the arm 39, is heated, resulting in its becoming curved, and the detent pin 38 emerges from the recess 35. The prestressed leg spring 36 rotates the now-released second coupling element 21 into the rotational position shown in FIG. 3, in the course of which the stop face 24 carries the coupler tang 22 with it and, via the first coupling element 20 and the control shaft 13, moves the throttle valve 10 until it comes to a stop in its closing position. To reactivate the restoring unit 17, the leg spring 36 must be tensed again, for instance manually, in the course of which the second coupling element 21 is again rotated back to its basic position shown in FIG. 4, in which the detent pin 38 on the cooled-down SME flexing element, in other words the now rectilinear arm 39, drops back into the recess 35 and thus locks the prestressed leg spring 36.

If the control motor 14 moves the throttle valve 10 to its maximally open position when the engine is shut off—as already described above—then instead of being manually tensed the le spring 36 can also be tensed with the aid of the control motor 14. Via the control shaft 13, the first coupling element 20 is rotated, and the second coupling element 21, via its stop face 24, is carried along by the coupler tang 22 tensing the leg spring 36, until reaching the basic position, in which the detent pin 38 drops into the recess 35 in the second coupling element 21. The throttle valve 10 can be closed again after that by reversing the control motor 14.

The arm 39 may be embodied as a bimetallic element instead, with no change in the above-described mode of operation of the adjuster. The detent pin 38 may equally well be disposed on the armature of an electromagnet, which in the case of a malfunction is excited via at least one of the two relays 33, 34 and as a result attracts its armature and thus pulls the detent pin 38 out of the recess 35.

Figure 5:
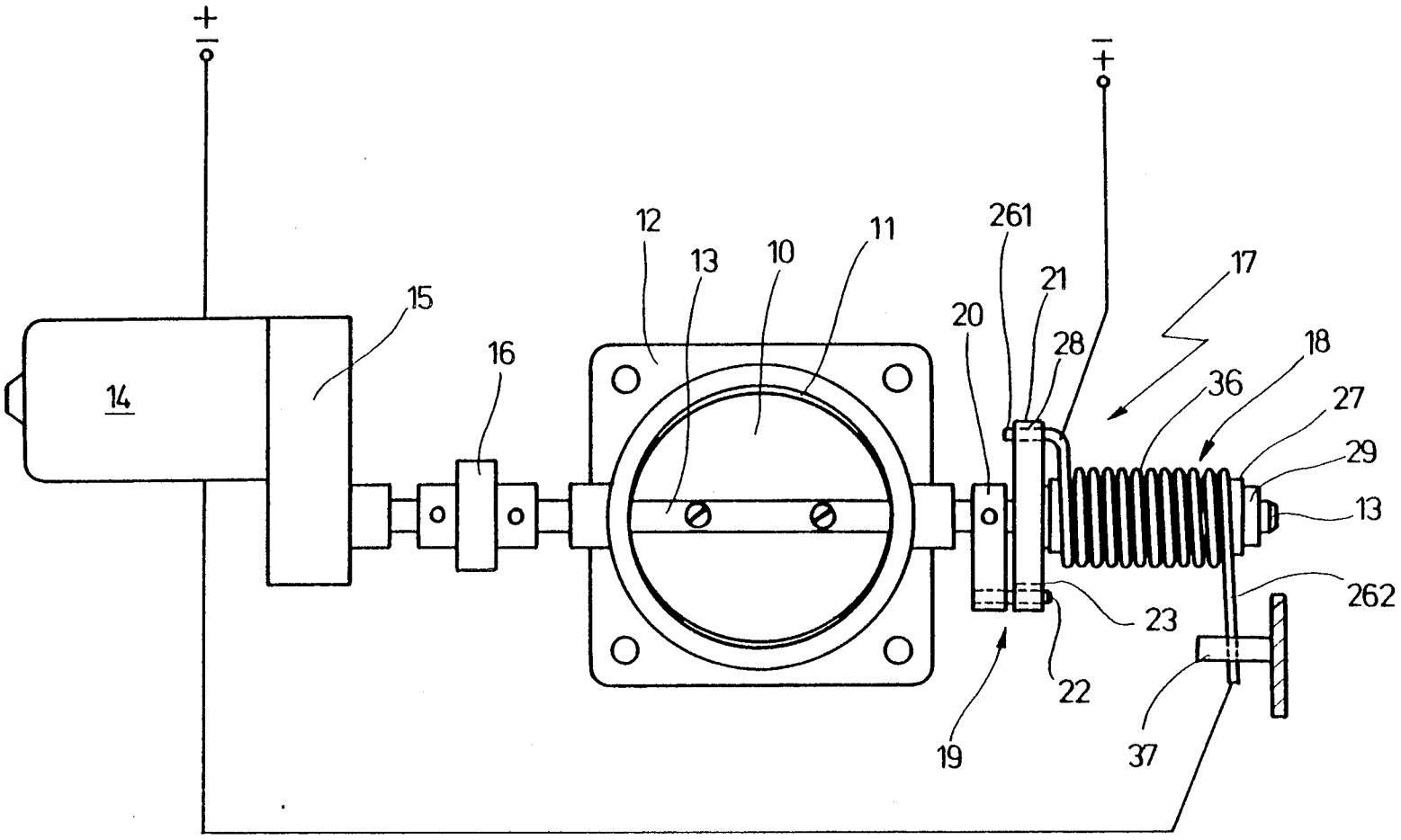
FIG. 5 is a side view of an adjuster in a third exemplary embodiment.

The adjuster shown in FIG. 5 for a throttle valve 10 is virtually completely identical to th adjuster of FIG. 1. The only difference is that the electrical wiring of the angle spring 26, embodied as an SME element, is different. The spring is connected in series with the control motor 14, so that during control operation it has current flowing through it and is thus heated to a temperature above its temperature point for the shape change. At this temperature, the angle spring 26 has a spring position relative to the second coupling element 21 of the coupling device 1 such that the second coupling element 21 assumes its basic position shown in FIG. 4, in which with the throttle valve 10 closed the coupler tang 22 of the first coupling element 20 rests on, or at least in the vicinity of, the stop face 25 of the coupler groove 23. The control motor 14 can pivot the throttle valve 10 without hindrance, in the course of which the first coupling element 20 is carried along as well, while its coupler tang 22 contrarily can move unhindered within the coupler groove 23 in the second coupling element 21.

In a malfunction, the supply of power to the control motor is interrupted. The heating current in the angle spring 26 is thus absent as well. The angle spring 26 cools down and drops below its temperature point for the shape change. On dropping below this temperature point, the angle spring 26 assumes its other rotational position, in which the end 261 of the angle spring 26 has pivoted by approximately 90°. During this shape changing process, the angle spring 26 performs work and pivots the second coupling element 21 by approximately 90° into the rotational position shown in FIG. 3. In this pivoting process, the stop face 24 of the coupler groove 23 strikes the coupler tang 22 and carries it with it a far as the final rotational position. Via the coupler tang 22, the first coupling element 20 and thus the control shaft 13 are rotated, until the throttle valve 10 comes to a stop in its closing position. If the adjuster is put back into operation after the defect has been eliminated, the angle spring 26 warms up again and changes to its other rotational position, in which the end 261 of the angle spring 26 pivots back in the opposite direction by approximately 90°. As a result, the second coupling element 21 is returned to its basic position shown in FIG. 4.

With this adjuster as well, the angle spring 26 can be embodied as an SME element with a unidirectional effect. Upon cooling down to a temperature below the temperature point for the shape change, the SME element then loses its adjusting force, and the throttle valve is closed by a mechanical restoring spring acting in the opposite direction.

The invention is not limited to the exemplary embodiments described. For instance, the SME elements in FIGS. 1, 2 and 5 may be heated indirectly by a separate heating coil, so that they themselves do not have current flowing through them. In that case the SME elements could be produced on the basis of an alloy of copper, zinc and aluminum, or of copper, aluminum and nickel. Instead of the angle spring or flexing element, other embodiments, such as a tension spring, compression spring, torsion bar, etc, may be used.

The exemplary embodiments shown show the throttle valve 10 as an example of an adjusting device and in this case the engine is an Otto engine, for example. The adjusting device may equally well be a governor rod of a Diesel engine, however,,or an adjusting lever of an electric motor, for instance. Actuation of the adjusting device is effected for instance by pivoting or axial displacement.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. An adjuster for an adjusting device, which includes an electric control motor for actuating the adjusting device, a restoring unit for moving the adjusting device to a defined basic position upon an interruption of a supply of power to the control motor, a restoring unit (17) having a restoring force is embodied such that its restoring force acting upon the adjusting device (10) is effective solely upon an interruption of the supply of power to the control motor (14).

2. An adjuster as defined by claim 1, in which the restoring unit (17) has a tensed restoring spring (18) and a coupling device (19) that is activatable upon an interruption of the supply of power to the control motor (14), the coupling device connects the restoring spring (18) and adjusting device (10) to one another.

3. An adjuster as defined by claim 2, in which the adjusting device (10) is mounted in a manner fixed against relative rotation on a control shaft (13) connected to the control motor (14); said coupling device (19) has a first coupling element (20), connected to the control shaft (13) in a manner fixed against relative rotation, and a second coupling element (21), seated rotatably on the control shaft (13); said first coupling element (20) includes a coupler tang (22) disposed radially spaced apart from the control shaft (13), said coupler tang (22) engages a coupler groove (23) of circular arc shape in the second coupling element (21), which groove extends over a maximum pivoting range of the coupler tang (22) and has one stop face (24, 25) on each end; said restoring spring (18) engages the second coupling element (21) with a restoring force acting in a rotational direction; and includes means for activating the restoring force.

4. An adjuster as defined by claim 3, in which the activating means for the restoring force are realized in that the restoring spring (18) is embodied as a memory metal element with shape memory, or SME (shape memory effect) element (26), and that the SME element (26), upon an interruption of the supply of power to the control motor (14), is heated to a temperature above its temperature point for the shape change.

5. An adjuster as defined by claim 4, in which the SME element is embodied as an angle spring (26), for instance of nickel-titanium metal, which is seated on an insulating sheath (27) slipped over the control shaft (13) and has current flowing through it upon an interruption of the supply of power to the control motor (14) to bring about a shape change.

6. An adjuster as defined by claim 5, in which the angle spring (26) is connected to a source (30) of heating current via at least one switch contact (31, 32) of at least one switch relay (33, 34), and that a relay winding of the at least one switch relay (33, 34) is located in the electrical circuit of the control motor (14).

7. An adjuster as defined by claim 3, in which the activating means for the restoring spring (18) has a detent pin (38) that engages a recess (35) in the second coupling element (21), and a lifter device (39) for lifting the detent pin (38) out of the recess, the lifter device being activatable upon an interruption to the supply of current to the control motor (14), and that the recess (35) is disposed in the second coupling element (21) in such a way that the recess (35) and the detent pin (38) are in alignment with one another for engagement when the restoring spring (18) is tensed.

8. An adjuster as defined by claim 7, in which the lifter device (39) is embodied by a unilaterally fastened flexible arm (39) carrying the detent pin (38) on its free end, the arm being embodied as a bimetallic element or as an SME element with a unidirectional effect; that a spring force acting in the engagement direction of the detent pin (38) and recess (35) engages the arm (39) near its free end; and that the arm (39) is heated upon an interruption to the power supply to the control motor (14).

9. An adjuster as defined by claim 8, in which the arm (39) is connected to a source (30) of heating current via at least on ®switch contact (31, 32) of at least one switch relay (33, 34), and that a relay winding of the at least one relay (33, 34) is located in the electrical circuit of the control motor (14).

10. An adjuster as defined by claim 7, in which the restoring spring (18) is embodied as an angle or leg spring (36), which is seated on the control shaft (13) and is supported in stationary fashion by one spring end (362) and by its other spring end (361) is secured to the second coupling element (21).

11. An adjuster as defined by claim 8, in which the restoring spring (18) is embodied as an angle or leg spring (36), which is seated on the control shaft (13) and is supported in stationary fashion by one spring end (362) and by its other spring end (361) is secured to the second coupling element (21).

12. An adjuster as defined by claim 9, in which the restoring spring (18) is embodied as an angle or leg spring (36), which is seated on the control shaft (13) and is supported in stationary fashion by one spring end (362) and by its other spring end (361) is secured to the second coupling element (21).

13. An adjuster as defined by claim 3, in which the activating means for the restoring force is realized in that the restoring spring (18) is embodied as a memory metal element with shape memory, or SME (shape memory effect) element (26), and that the SME element (26) is heated to a temperature above its temperature point for the shape change only during the supply of power to the control motor (14)

14. An adjuster as defined by claim 13, in which the SME element is embodied as an angle spring (26), for instance of nickel-titanium metal, which is seated on an insulating sheath (27) slipped over the control shaft (13) and is connected electrically in series with the control motor (14).

* * * * *